US012495871B2

(12) United States Patent
Covenden et al.

(10) Patent No.: US 12,495,871 B2
(45) Date of Patent: Dec. 16, 2025

(54) DECORATIVE NECKLACE FITTING SYSTEM

(71) Applicants: Jacqueline Lorraine Covenden, Lake Newell Resort (CA); Brooklyn Gauthier, Lake Newell Resort (CA)

(72) Inventors: Jacqueline Lorraine Covenden, Lake Newell Resort (CA); Brooklyn Gauthier, Lake Newell Resort (CA)

( * ) Notice: Subject to any disclaimer, the term of this patent is extended or adjusted under 35 U.S.C. 154(b) by 0 days.

(21) Appl. No.: 18/503,493

(22) Filed: Nov. 7, 2023

(65) Prior Publication Data

US 2025/0143420 A1 May 8, 2025

(51) Int. Cl.
*A44C 15/00* (2006.01)
*A44C 5/00* (2006.01)
*A44C 5/20* (2006.01)

(52) U.S. Cl.
CPC ..... *A44C 15/005* (2013.01); *A44C 5/2009* (2013.01)

(58) Field of Classification Search
CPC ... A44C 15/005; A44C 5/2009; A44C 5/0053; A44C 5/0061; A44C 5/02; A44C 5/10; A44C 11/00; A44C 25/001; A44C 17/0208; A44C 15/00; A44C 17/0216; A44C 17/0225; A44C 9/00; A44C 25/007; A45C 11/16; A47F 7/02
USPC ..... 63/29.1, 6.1, 3, 4, 40
See application file for complete search history.

(56) References Cited

U.S. PATENT DOCUMENTS 1,775,932 A * 9/1930 Cummings ..... A47F 7/02 312/118
4,448,304 A * 5/1984 Weinzettel ..... A44C 17/02 434/81
D810,605 S * 2/2018 Zachos ..... D11/13

* cited by examiner

*Primary Examiner* — Jack W Lavinder
(74) *Attorney, Agent, or Firm* — Orin Del Vecchio

(57) ABSTRACT

A necklace fitting system that is operable to demonstrate a plurality of exemplary necklace lengths on a user wherein the present invention employs only a portion of the precious metal necklace. The present invention includes a base chain member wherein the base chain member includes a first end and a second end. The base chain member has integrally formed thereon a plurality of connection members. A first connection member is proximate the first end of the bae chain member and the remaining connection members are equally spaced between the first connection member and the second end of the base chain member. A plurality of sample members are provided wherein the sample members are six inches in length and are manufactured of the desired precious metal and style that a user is desiring to inspect visual appearance ensuing donning thereof. Exemplary lengths ranging from fourteen to thirty inches are provided.

8 Claims, 2 Drawing Sheets

DECORATIVE NECKLACE FITTING SYSTEM

FIELD OF THE INVENTION

The present invention relates generally to jewelry appearance, more specifically but not by way of limitation, a decorative necklace fitting system that is operable to demonstrate how the full length of a necklace will fit and display on a person wherein the system of the present invention employs only a small portion of the actual decorative necklace.

BACKGROUND

Jewelry has been worn by humans for thousands of years, Jewelry has been worn throughout time for reasons such as but not limited to identification of belonging to a group, religious purposes or as a symbol of social status. There are many different types of jewelry that include but are not limited to rings, earrings and necklaces. Necklaces are popular both with men and women and are worn across most cultures and races in the world today. As is known in the art, necklaces are manufactured from a variety of different materials such as but not limited to gold and silver. There are thousands of styles of necklaces and each style is typically available in different parameters such as but not limited to thickness and length.

One issue with those entities that are involved in selling necklaces is the cost associated with having the different styles, lengths and thickness of necklaces accessible to a customer for the purpose of donning the necklace and inspecting the appearance thereof. As necklaces are manufactured from precious metals, it is cost prohibitive for many entities to have available all of the various lengths and thicknesses of a particular necklace. The appearance of the necklace is very important to a consumer and the consumer most often desires to visually inspect the appearance of a desired necklace prior to the purchase thereof. If a jewelry does not have a particular length or thickness of a necklace, the consumer may not purchase due to the inability to visually inspect the appearance of the necklace on themselves.

Accordingly, there is a need for a decorative necklace fitting system that employs a multitude of portions of alternate styles and thickness of necklaces wherein the present invention further includes a base chain member having a plurality of connection members

SUMMARY OF THE INVENTION

It is the object of the present invention to provide a decorative necklace fitting system operable to demonstrate the appearance of a necklace with only a portion thereof wherein the present invention includes a base chain member.

Another object of the present invention is to provide a necklace fitting system that facilitates an ability for an individual to visually inspect the appearance of different lengths of necklace as worn on the individual wherein the base chain member includes a plurality of connection members.

A further object of the present invention is to provide a decorative necklace fitting system operable to demonstrate the appearance of a necklace with only a portion thereof wherein the system of the present invention employs a sample portion of a decorative necklace.

Yet a further object of the present invention is to provide a necklace fitting system that facilitates an ability for an individual to visually inspect the appearance of different lengths of necklace as worn on the individual wherein the sample portion is connected to alternate connection members on the base chain member to create a necklace of a desired length for donning thereof.

Still another object of the present invention is to provide a decorative necklace fitting system operable to demonstrate the appearance of a necklace with only a portion thereof wherein the connection members are located on the base chain member at evenly spaced locations.

An additional object of the present invention is to provide a necklace fitting system that facilitates an ability for an individual to visually inspect the appearance of different lengths of necklace as worn on the individual wherein the present invention includes a storage member.

Yet a further object of the present invention is to provide a decorative necklace fitting system operable to demonstrate the appearance of a necklace with only a portion thereof wherein the storage member includes a plurality of storage compartments.

To the accomplishment of the above and related objects the present invention may be embodied in the form illustrated in the accompanying drawings. Attention is called to the fact that the drawings are illustrative only. Variations are contemplated as being a part of the present invention, limited only by the scope of the claims.

BRIEF DESCRIPTION OF THE DRAWINGS

A more complete understanding of the present invention may be had by reference to the following Detailed Description and appended claims when taken in conjunction with the accompanying Drawings wherein:

DETAILED DESCRIPTION

Figure 1:
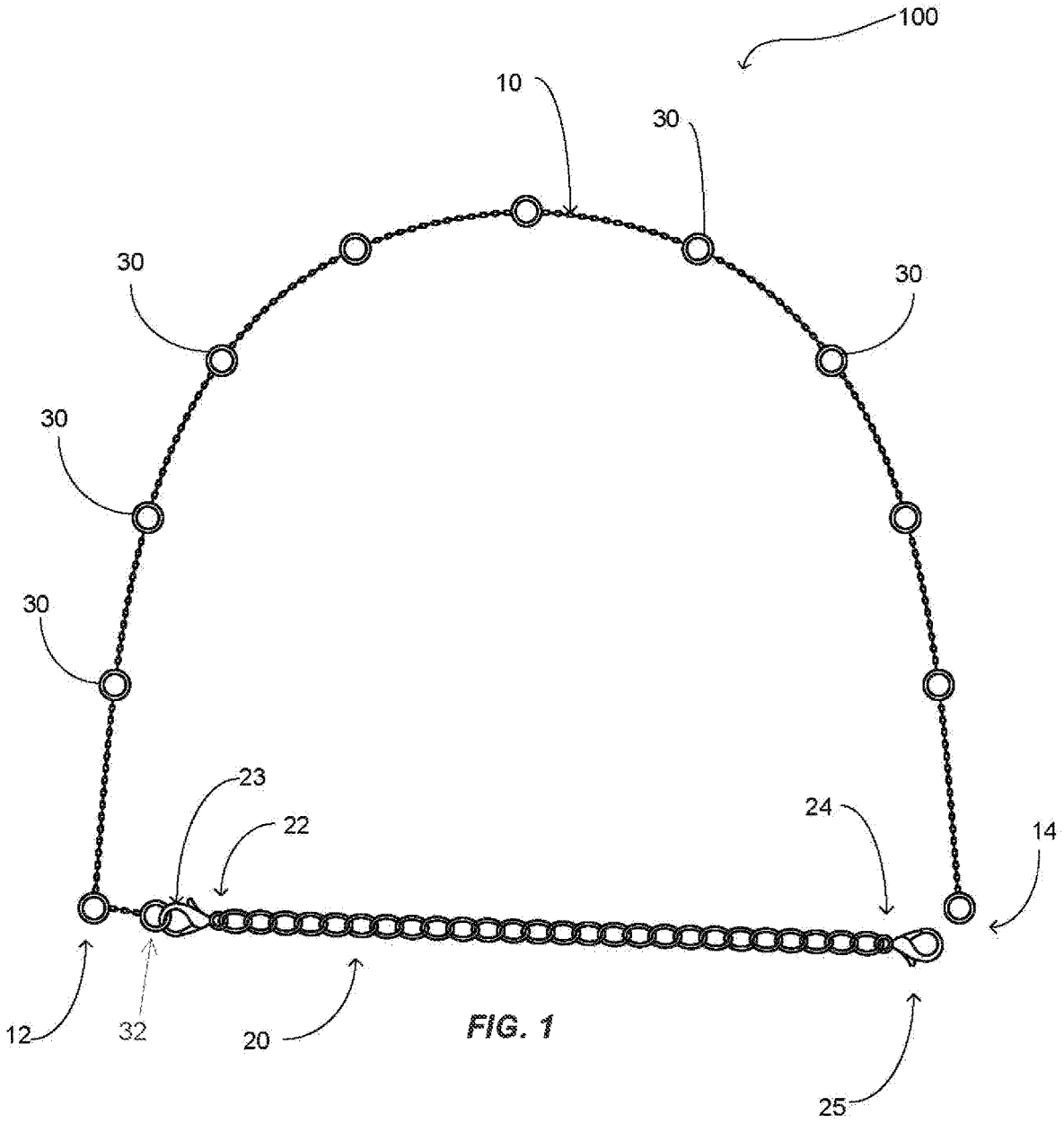
FIG. 1 is a perspective view of the base chain member operably coupled to a sample chain portion.
Figure 2:
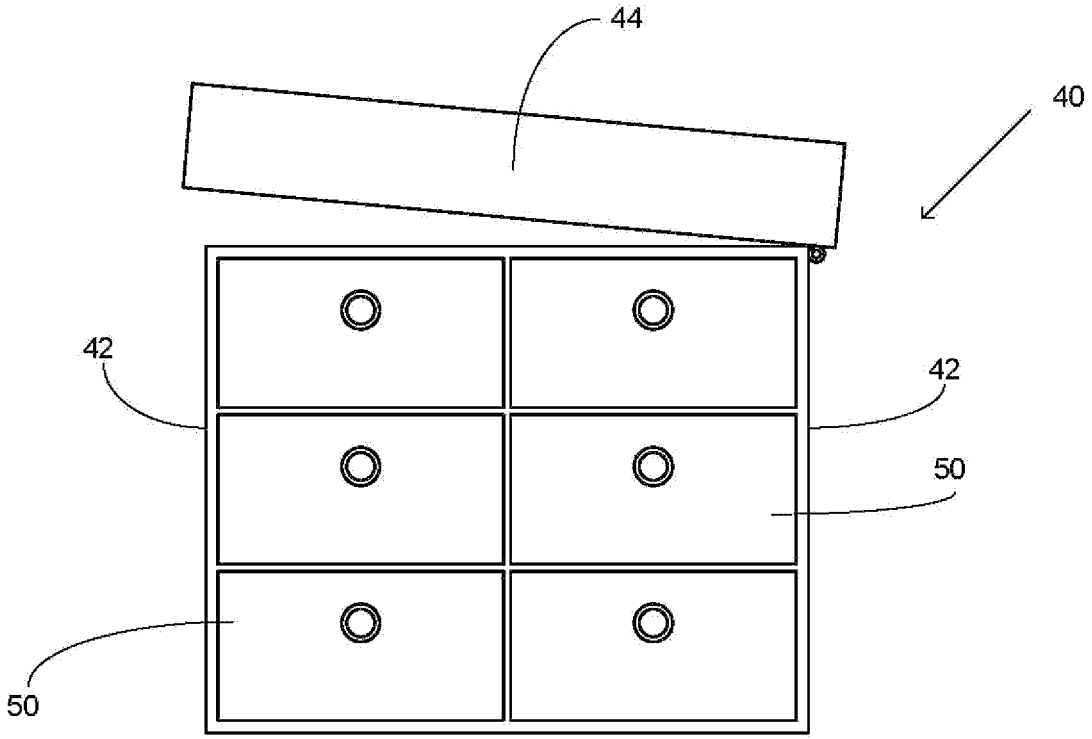
FIG. 2 is a front view of the storage member of the present invention.

Referring now to the drawings submitted herewith, wherein various elements depicted therein are not necessarily drawn to scale and wherein through the views and figures like elements are referenced with identical reference numerals, there is illustrated a necklace fitting system 100 constructed according to the principles of the present invention.

An embodiment of the present invention is discussed herein with reference to the figures submitted herewith. Those skilled in the art will understand that the detailed description herein with respect to these figures is for explanatory purposes and that it is contemplated within the scope of the present invention that alternative embodiments are plausible. By way of example but not by way of limitation, those having skill in the art in light of the present teachings of the present invention will recognize a plurality of alternate and suitable approaches dependent upon the needs of the particular application to implement the functionality of any given detail described herein, beyond that of the particular implementation choices in the embodiment described herein. Various modifications and embodiments are within the scope of the present invention.

It is to be further understood that the present invention is not limited to the particular methodology, materials, uses and applications described herein, as these may vary. Furthermore, it is also to be understood that the terminology used herein is used for the purpose of describing particular embodiments only, and is not intended to limit the scope of the present invention. It must be noted that as used herein and in the claims, the singular forms "a", "an" and "the" include the plural reference unless the context clearly dictates otherwise. Thus, for example, a reference to "an element" is a reference to one or more elements and includes equivalents thereof known to those skilled in the art. All conjunctions used are to be understood in the most inclusive sense possible. Thus, the word "or" should be understood as having the definition of a logical "or" rather than that of a logical "exclusive or" unless the context clearly necessitates otherwise. Structures described herein are to be understood also to refer to functional equivalents of such structures. Language that may be construed to express approximation should be so understood unless the context clearly dictates otherwise.

References to "one embodiment", "an embodiment", "exemplary embodiments", and the like may indicate that the embodiment(s) of the invention so described may include a particular feature, structure or characteristic, but not every embodiment necessarily includes the particular feature, structure or characteristic.

Referring in particular to the Figures submitted herewith, the necklace fitting system 100 includes a base chain member 10. The base chain member 10 is elongated in form having a first end 12 and a second end 14. The base chain member 10 is manufactured from a durable material such as but not limited to metal chain. It should be understood within the scope of the present invention that the base chain member 10 could be manufactured from various alternate suitable materials.

Operably coupled to the base chain member 10 is the sample member 20. The sample member 20 has a first end 22 and a second end 24. The sample member 20 has a first coupler 23 located at the first end 22 and a second coupler 25 located at the second end 24. As is further discussed herein, the first coupler 23 and second coupler 25 are utilized to releasably secure the sample member 20 to the base chain member 10. While a particular style of coupler is illustrated herein for the first coupler 23 and second coupler 25, it should be understood within the scope of the present invention that the first coupler 23 and second coupler 25 could be manufactured from various different styles of clasps. The necklace fitting system 100 is provided with a multitude of sample members 20. The sample members 20 are manufactured from precious metals and are the style and thickness that a user of the necklace fitting system 100 is contemplating purchasing a full length decorative necklace of the material and size represented by the sample member 20. As is further discussed herein, the sample member 20 is releasably coupled to the base chain member 10 at a connection member 30 that is configured to facilitate demonstration of a particular length of necklace which would be manufactured from the material of the sample member 20. In a preferred embodiment of the present invention the sample member 20 is provided in a six inch length in order to facilitate a final exemplary length in various combinations once releasably coupled to the base chain member 10 as is further discussed herein.

The base chain member 10 includes plurality of connection members 30 integrally formed as a part thereof and spaced evenly intermediate first end 12 and second end 14. The connection members 30 are annular in shape and are configured to be releasably coupled to the first coupler 23 and second coupler 25. The first connection member 32 is located eight inches from the first end 12. This spacing functions to combine with the six inch sample member 20 wherein a exemplary necklace length of fourteen inches is produced upon coupling of the sample member 20 to the first end 12 and first connection member 32. Once donned, the necklace fitting system 100 demonstrates to a user the appearance of the sample member 20 as it would appear as the length created by the combining of the sample member 20 and the base chain member 10. The subsequent connection members 30 intermediate the first connection member 32 and second end 14 have a spacing therebetween of two inches. This spacing facilitates the ability to create exemplary necklace lengths of sixteen to thirty inches wherein the exemplary necklace lengths created have a length difference therebetween of two inches. While particular measurements have been disclosed herein to facilitate creation of an exemplary necklace length by releasably coupling the sample member 20 to connection members 30 of the base chain member 10, it is contemplated within the scope of the present invention that alternate measurements could be employed.

Figure 3:
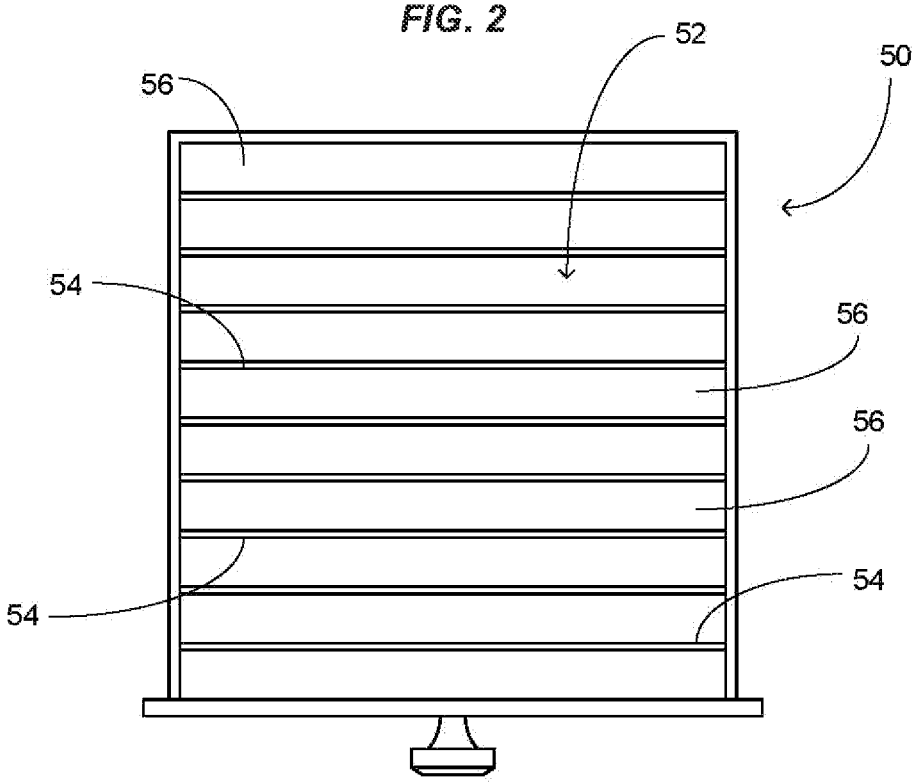
FIG. 3 is a top view of the interior volume of a storage compartment of the storage member.

The necklace fitting system 100 further includes a storage member 40. The storage member 40 is manufactured from a durable rigid material such as but not limited to wood or plastic. The storage member 40 includes a plurality of walls 42 integrally formed to create an interior volume and further includes a lid member 44 that is hingedly coupled to the storage member 40 proximate the top thereof. The storage member 40 is configured to receive and retain therein a plurality of storage compartments 50. The storage compartments 50 are slidably coupled to the storage member 40 and are configured to receive and store a plurality of sample members 20. As is illustrated in FIG. 3 submitted as a part hereof, the storage compartment 50 includes an interior volume 52 having a plurality of divider members 54. The divider members 54 are operable to create storage spaces 56 wherein each storage space is configured to house a sample member 20. It should be understood within the scope of the present invention that the storage compartment 50 could include various quantities of divider members 54 creating alternate quantities of storage spaces 56. In a preferred embodiment of the present invention, each storage compartment 50 stores a sample member 20 manufactured from the same precious metal and of the same style but alternate thickness so as to make available to a user of the necklace fitting system 100.

In the preceding detailed description, reference has been made to the accompanying drawings that form a part hereof, and in which are shown by way of illustration specific embodiments in which the invention may be practiced. These embodiments, and certain variants thereof, have been described in sufficient detail to enable those skilled in the art to practice the invention. It is to be understood that other suitable embodiments may be utilized and that logical changes may be made without departing from the spirit or scope of the invention. The description may omit certain information known to those skilled in the art. The preceding detailed description is, therefore, not intended to be limited to the specific forms set forth herein, but on the contrary, it is intended to cover such alternatives, modifications, and equivalents, as can be reasonably included within the spirit and scope of the appended claims.

What is claimed is:

1. A necklace fitting system that is configured to provide an ability for a user thereof to visually inspect appearance of a decorative necklace at alternate lengths having only a portion of the decorative necklace present wherein the necklace fitting system comprises:

a base chain member, said base chain member having a first end and a second end, said base chain member being elongated in form;

a plurality of connection members, said plurality of connection members being operably coupled to said base chain member, said plurality of connection members including a first connection member, said plurality of connection members other than the first connection member being spaced along said base chain member at equal distances, said plurality of connection members being structurally and visually distinct from said base chain member;

a sample member, said sample member being the portion of the decorative necklace, said sample member having a first end and a second end, said sample member having a first coupler at said first end, said sample member having a second coupler at said second end, said sample member configured to be releasably secured to said base chain member, said sample member being manufactured from an alternate material than said base chain member, wherein the combination of said base chain member and said sample member forms a complete necklace representative of the decorative necklace at a length determined by the coupling of said sample member to said base chain member.

2. The necklace fitting system that is configured to provide an ability for a user thereof to visually inspect appearance of a decorative necklace at alternate lengths as recited in claim 1, wherein said first connection member is located eight inches from said first end of said base chain member.

3. The necklace fitting system that is configured to provide an ability for a user thereof to visually inspect appearance of a decorative necklace at alternate lengths as recited in claim 2, wherein said plurality of connection members are ring shaped.

4. The necklace fitting system that is configured to provide an ability for a user thereof to visually inspect appearance of a decorative necklace at alternate lengths as recited in claim 3, wherein said plurality of connection members intermediate said first connection member and said second end of said base chain member have a spacing therebetween of two inches.

5. The necklace fitting system that is configured to provide an ability for a user thereof to visually inspect appearance of a decorative necklace at alternate lengths as recited in claim 4, wherein said sample member is six inches in length.

6. The necklace fitting system that is configured to provide an ability for a user thereof to visually inspect appearance of a decorative necklace at alternate lengths as recited in claim 5, and further including a storage member, said storage member having a plurality of storage compartments slidably disposed therein.

7. The necklace fitting system that is configured to provide an ability for a user thereof to visually inspect appearance of a decorative necklace at alternate lengths as recited in claim 6, wherein said plurality of storage compartments include a plurality of divider members creating storage spaces configured to receive and retain a sample member therein.

8. The necklace fitting system that is configured to provide an ability for a user thereof to visually inspect appearance of a decorative necklace at alternate lengths as recited in claim 7, wherein said sample member and said base chain member are configured to provide exemplary necklace lengths upon operable coupling thereof between fourteen and thirty inches.

* * * * *